US008912460B2

(12) United States Patent
Curry et al.

(10) Patent No.: US 8,912,460 B2
(45) Date of Patent: Dec. 16, 2014

(54) DIELECTRIC LOADED FLUIDS FOR HIGH VOLTAGE SWITCHING

(75) Inventors: Randy D. Curry, Columbia, MO (US); Christopher Yeckel, Columbia, MO (US); Daniel Crosby, Hallsville, MO (US)

(73) Assignee: The Curators of the University of Missouri, Columbia, MO (US)

( * ) Notice: Subject to any disclaimer, the term of this patent is extended or adjusted under 35 U.S.C. 154(b) by 0 days.

(21) Appl. No.: 13/479,037

(22) Filed: May 23, 2012

(65) Prior Publication Data

US 2013/0062314 A1 Mar. 14, 2013

Related U.S. Application Data

(60) Provisional application No. 61/489,094, filed on May 23, 2011.

(51) Int. Cl.

| | |
|---|---|
| ***H01B 3/22*** | (2006.01) |
| ***H01B 3/20*** | (2006.01) |
| ***H01H 33/22*** | (2006.01) |
| *H01H 33/68* | (2006.01) |
| *H01H 33/92* | (2006.01) |

(52) U.S. Cl.

CPC ..... *H01H 33/22* (2013.01); *H01H 33/68* (2013.01); *H01H 2300/036* (2013.01); *H01H 33/92* (2013.01); *H01B 3/22* (2013.01); *Y10S 977/773* (2013.01)

USPC ..... 218/91; 252/570; 252/572; 252/573; 977/773

(58) Field of Classification Search

USPC ..... 218/91; 252/570, 572, 573

See application file for complete search history.

(56) References Cited

U.S. PATENT DOCUMENTS

| | | | | |
|---|---|---|---|---|
| 3,928,705 | A * | 12/1975 | Loft et al. | 174/25 C |
| 4,142,223 | A * | 2/1979 | Shaw | 361/319 |
| 4,290,926 | A * | 9/1981 | Shaw | 252/579 |
| 4,536,331 | A * | 8/1985 | Shedigian | 252/579 |
| 6,787,080 | B1 * | 9/2004 | Lange et al. | 264/86 |
| 8,129,487 | B2 * | 3/2012 | Busico et al. | 526/114 |
| 2007/0046398 | A1 * | 3/2007 | Nguyen et al. | 333/186 |
| 2012/0245016 | A1 * | 9/2012 | Curry et al. | 501/137 |
| 2013/0115462 | A1 * | 5/2013 | Mazyar et al. | 428/403 |

OTHER PUBLICATIONS

Curry et al. Pulsed Power conference (IEEE) Jun. 16, 2005. De Anza III.*

Panghorn et al. Organometallics, 1996 15, 1518-1520.*

Yeckel et al. IEEE Transactions on Plasma Science, vol. 38, No. 10. Oct. 2010.*

Matthews et al. Ind. Eng. Chem. Res. 2002, 41, 4475-4478.*

Chiesa et al. Physiochem. Eng. Aspects 335 (2009) 88-79.*

Nycodiel Technical Data Sheet. 2007.*

* cited by examiner

*Primary Examiner* — Nicole M Buie-Hatcher
*Assistant Examiner* — M. Reza Asdjodi
(74) *Attorney, Agent, or Firm* — Polsinelli PC

(57) ABSTRACT

This disclosure relates to methods and systems to reduce high voltage breakdown jitters in liquid dielectric switches. In particular, dielectric liquids have been produced that contain a suspension of nanoparticles and a surfactant to reduce the breakdown jitter. In one embodiment, the suspended nanoparticles are Barium Strontium Titanate (BST) nanoparticles.

19 Claims, 6 Drawing Sheets

DIELECTRIC LOADED FLUIDS FOR HIGH VOLTAGE SWITCHING

CROSS REFERENCE TO RELATED APPLICATIONS

This application claims priority to U.S. Provisional Application No. 61/489,094, entitled "Dielectric Loaded Fluids for High Voltage Switching," filed on May 23, 2011.

FEDERALLY SPONSORED RESEARCH OR DEVELOPMENT

This invention was made with government support under grant number W9113M-09-C-0046 awarded by the US Army Space & Missile Defense Command. The government has certain rights in the invention.

FIELD OF THE INVENTION

The invention generally relates to a dielectric fluid that can be used to reduce the voltage breakdown jitter in high voltage switches and spark gaps. The invention further relates to methods of reducing the voltage breakdown jitter in high voltage switches and spark gaps, various methods of preparing the dielectric fluid, and high voltage switches incorporating the dielectric fluid. Generally, the dielectric fluid is pressurized, filtered and may include a nanoparticle suspension.

BACKGROUND OF THE INVENTION

The design and characterization of dielectrics is critical for optimum high-voltage switch performance. Previous attempts to optimize switch performance, such as the tuning of the oil pressure and flow rates for oil dielectrics, have dramatically reduced the rep-rate self-break jitter by eliminating breakdown byproducts.

During self-break operation, however, switches using oil dielectrics may still demonstrate erratic breakdown patterns. Some switches have shown percentages of standard deviation from the mean breakdown as high as 20%. This is problematic for electrical loads that require uniform pulse repetition. Therefore, there remains a need to further reduce the voltage breakdown jitter in high voltage switches and spark gaps.

SUMMARY OF THE INVENTION

The present disclosure relates to systems and methods for reducing the voltage breakdown jitter in high voltage switches and other applications. In one embodiment, a method for preparing a dielectric fluid to reduce voltage breakdown jitter in a high voltage spark gap includes providing a dielectric fluid, sparging the dielectric fluid with dry nitrogen, and adding a plurality of nanoparticles to the dielectric fluid. The method further includes adding a surfactant to the dielectric fluid, sonicating the dielectric fluid, filtering the dielectric fluid, and pressurizing the dielectric fluid.

In various embodiments, the dielectric fluid is a polyolefin having a chemical formula of $C_{16}H_{32}$, such as 1-Hexadecane or a hydrocarbon-based coolant fluid, such as NYCODIEL. The method may further include sparging the dielectric fluid with dry nitrogen to reduce the water content of a dielectric oil to less than approximately 20 ppm or less.

In one embodiment, the plurality of nanoparticles have a dielectric constant ranging from 20-6000 and may be composed of Barium Strontium Titanate (BST) nanoparticles. The nanoparticles range in diameter from about 50 nm to about 250 nm and may be added to obtain a concentration in the dielectric fluid ranging between 0.1% and 10% by weight. In various embodiments, the ratio of the dielectric constant of the plurality of nanoparticles to the dielectric constant of the dielectric fluid is at least 3:1, 10:1, 2000:1, or greater.

In another embodiment, the surfactant is added to obtain a concentration in the dielectric fluid ranging between 0.1% and 10% by weight. In one embodiment of the method, the dielectric fluid is pressurized to between about 10 psig and 2,500 psig. In another embodiment, the dielectric fluid is pressurized to approximately atmospheric pressure.

In another embodiment, a method for reducing voltage breakdown jitter in a high voltage switch includes providing two or more electrodes separated by a gap and providing a pressurized dielectric suspension between the electrodes. The dielectric suspension includes a dielectric fluid, a surfactant to reduce a breakdown voltage of the dielectric fluid and remove carbon from at least one of the two or more electrodes, and a plurality of nanoparticles to enhance the formation of streamers thereby reducing an electrode gap.

The method also includes applying a voltage across the two or more electrodes to form an electric field between the two or more electrodes. The reduction of the breakdown voltage and the formation of streamers enhance the electric field between the two or more electrodes to reduce the voltage breakdown jitter in the gap. In one embodiment, the voltage breakdown jitter is decreased by 10% or greater. In another embodiment, the voltage breakdown jitter is decreased by a factor of 2 or greater. For example, the jitter may be decreased by a factor ranging between 2 and 3. In yet another embodiment, the voltage breakdown jitter is decreased by a factor of 10 or greater. In other embodiments, the gap is between 5 μm and 2000 μm, while the applied voltage ranges from about 2 kV to about 10 MV.

In one embodiment, a dielectric to reduce jitter in a high voltage spark gap between an anode and a cathode includes a pressurized hydrocarbon-based fluid having a first dielectric constant and a plurality of nanoparticles having a second dielectric constant, where the ratio of the second dielectric constant to the first dielectric constant is approximately 3 to 1. The dielectric also includes a surfactant to suspend the plurality the nanoparticles in the fluid, to reduce the voltage breakdown of the fluid, and to remove carbon particles from the surface of an electrode. The high voltage spark gap may be a component of a high voltage switch. In one embodiment, the high voltage switch is selected from a group consisting of a laser-triggered switch, an electrically triggered trigatron, or an electric substation switch. In various embodiments, the shape of the plurality of nanoparticles may be tailored to induce specific breakdown characteristics.

In another embodiment, an electric switch system includes at least two electrodes separated by a gap and a dielectric liquid including a surfactant and a suspension of nanoparticles. The switch system may also include a high-pressure pump and a filter system. The liquid may be continuously pumped through the gap.

DETAILED DESCRIPTION OF THE INVENTION

The present disclosure relates to a dielectric fluid that reduces the voltage breakdown jitter in high voltage switches and spark gaps. In various embodiments, the dielectric fluid can be used in flowing or pressurized nonflowing spark gaps. In one aspect, the pressurized fluid reduces the size of the vapor bubble resulting from the arc in the liquid. An isostatic pressure is applied reducing the size of the vapor bubble. The isostatic pressure also increases the voltage breakdown jitter of the switch. The pressure inherently reduces microbubbles that result from the formation of electrons emitted from the cathode surface. Typically, the emitted electrons result from high electrical field levels at the surface of the cathode that are caused by electrode pitting and the electrode gap spacing.

In a high pressure spark gap, a minimum of 2 electrodes are utilized for the switch. By way of example, and not limitation, exemplary high voltage switches are disclosed in U.S. Pat. Nos. 7,312,412 and 7,390,984 to Cravey et al., both of which are hereby incorporated by reference in their entireties. In various embodiments, the switch operates at voltages ranging from approximately 2 kV to approximately 10 MV, with subsequent currents that range from about 100 A to about 5 MA.

Various testing to identify one or more embodiments of the invention were conducted and presented in "*Electrostatic Field Simulation Study of Nanoparticles Suspended in Synthetic Insulating Oil,*" *IEEE Transactions on Plasma Science*, Vol. 38 Issue 10, pp. 2514-2519, herein incorporated by reference in its entirety. The dielectric fluid has applications to laser-triggered and electrically-triggered trigatron designs, and other triggered spark gaps that utilize a fluid. Spark gaps that utilize fluids of this type may one day be used in the electrical industry to replace SF6, a gas that is believed to destroy ozone. Other potential applications include use within various components of electric substations, directed energy systems, or pulsed power systems.

Figure 1:
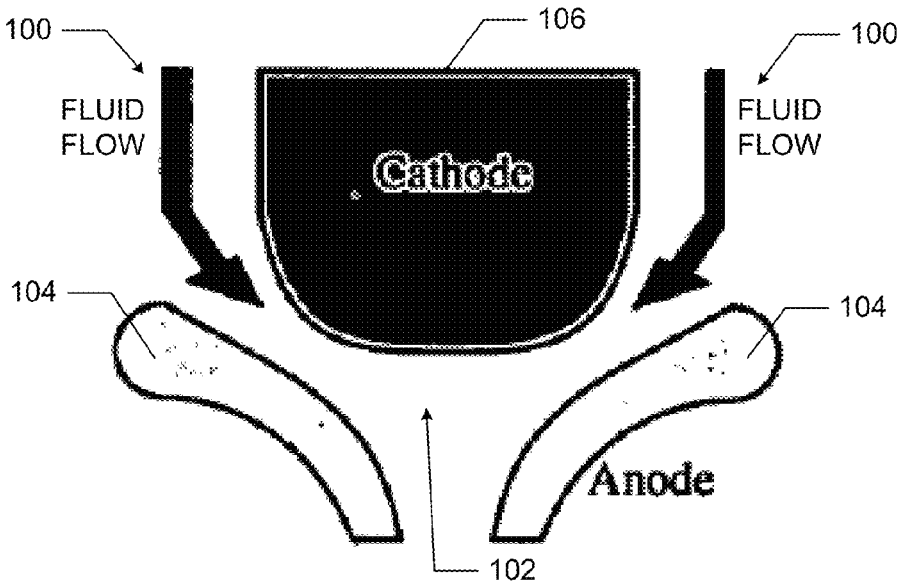
FIG. 1 depicts an exemplary high-voltage switch geometry.

A dielectric fluid 100, according to one embodiment, is shown in FIG. 1 as flowing through a gap 102 between a set of electrodes 104 and 106, (e.g. an anode and a cathode) for an exemplary switch 108. In one embodiment, the dielectric fluid 100 is an oil. Preferably, the dielectric fluid 100 is a polyolefin having a chemical formula of $C_{16}H_{32}$ or a hydrocarbon-based coolant fluid. In one embodiment, the dielectric fluid 100 is 1-Hexadecene. In another embodiment, the dielectric fluid 100 is NYCODIEL, a coolant fluid produced by Nyco. In various other embodiments, the dielectric fluid 100 is any dielectric liquid, including a poly-alpha-olefin (PAO), which is suitable for use in a spark gap. By way of example and not limitation, the dielectric fluid 100 may be a silicone-based oil or water. In other examples, the dielectric fluid 100 may include one or more oils.

Nanoparticles

Figure 3:
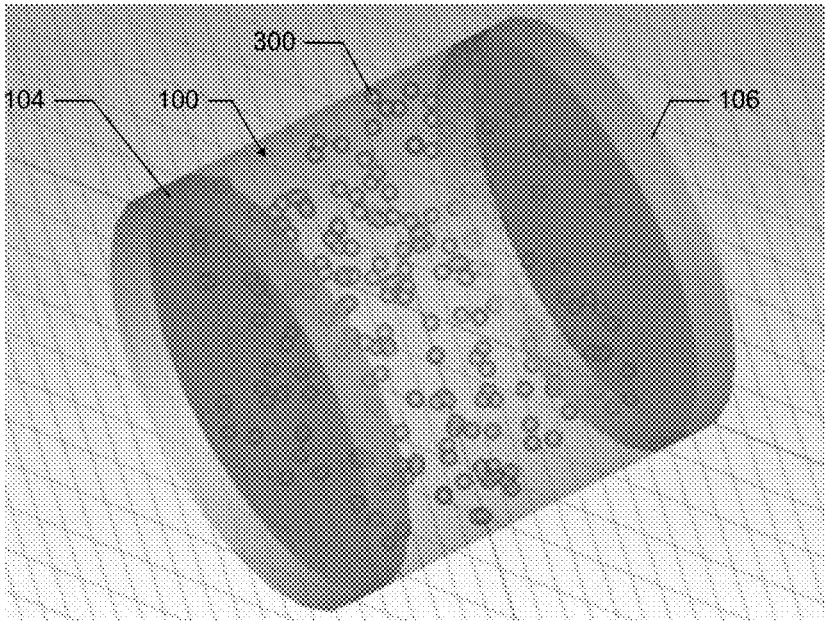
FIG. 3 depicts a three-dimensional model of an electrode system according to one embodiment.
Figure 4:
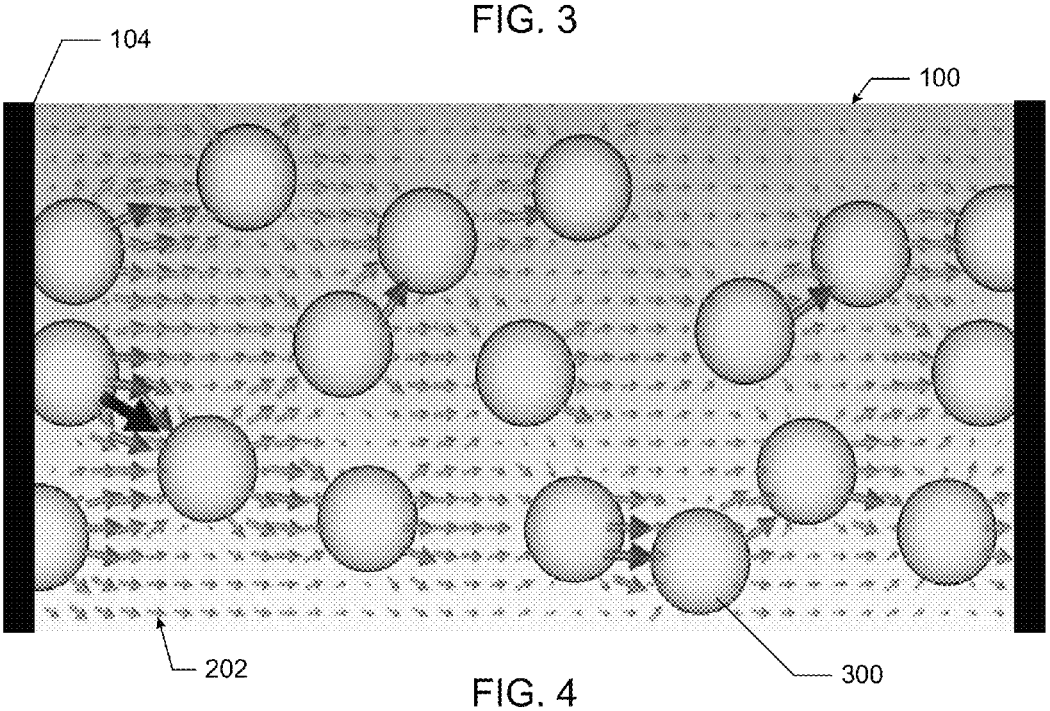
FIG. 4 depicts a two-dimensional cross-sectional view of the three-dimensional model of FIG. 3.

In one embodiment, the dielectric fluid 100 includes a number of particles, such as a nanoparticle 300, as shown in FIGS. 3 and 4, that act as field enhancements. The nanoparticle 300 presents an artificial geometry that allows the electric field to be enhanced in the fluid. The nanoparticle 300 also enhances the formation of streamers in the dielectric fluid 100. The streamers in turn, effectively close the electrode gap 102 to form an arc, when a voltage is applied to the electrodes 104 and 106.

The nanoparticle 300 may be composed of any material having a high dielectric constant, including but not limited to ceramics. Preferably, the nanoparticle 300 is a Barium-Strontium-Titanate (BST) nanoparticle. In various embodiments, the nanoparticle 300 has a dielectric constant that ranges from 20 to 6000. The dielectric constant of an exemplary BST nanoparticle is approximately 2000. In another embodiment, the nanoparticle 300 has a dielectric constant that is at least 3 times greater than the dielectric constant of the dielectric fluid 100. In a preferred embodiment, the nanoparticle 300 has a dielectric constant that is at least 10 times greater than the dielectric constant of the dielectric fluid 100.

In one embodiment, the nanoparticles 300 within the dielectric fluid 100 have uniform composition and dielectric constants. In another embodiment, the dielectric fluid 100 may include a distribution of nanoparticles 300 having mixed compositions and/or dielectric constants. In various embodiments, the nanoparticles 300 are added to the dielectric fluid 100 to achieve a final concentration that ranges from approximately 0.1% weight by volume (w/v) to 10% w/v or higher.

The size of the nanoparticle 300 can be selected to provide for the optimum field enhancement to reduce the voltage breakdown jitter. Preferably, the nanoparticles 300 range in diameter from 50 nm to about 250 nm. The nanoparticles 300 may, however, agglomerate to form clusters that may be several microns in diameter.

Figure 2:
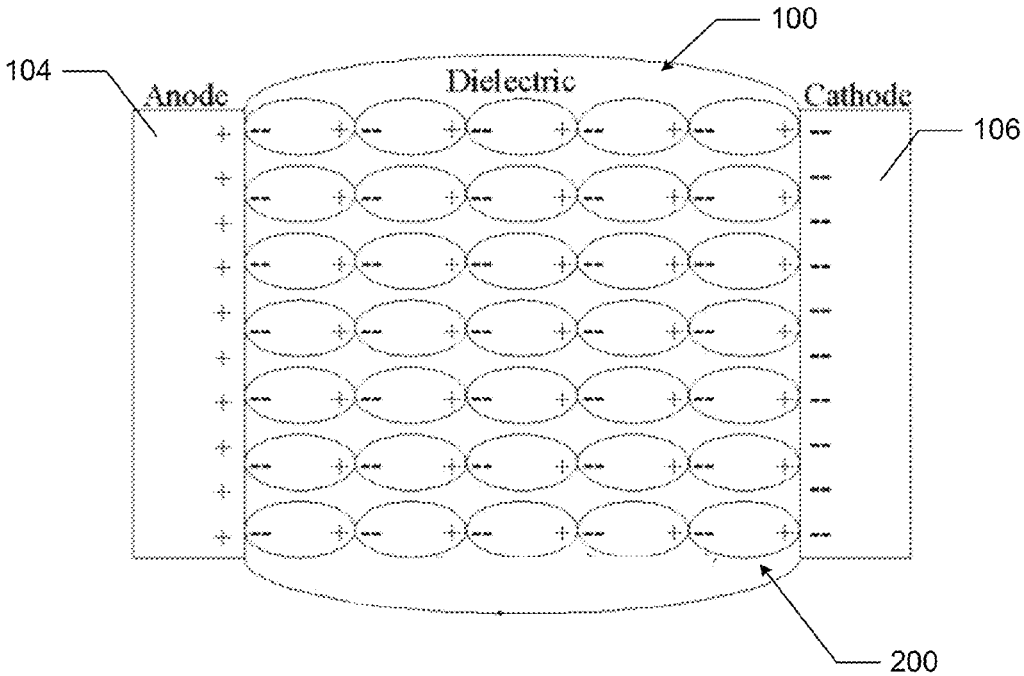
FIG. 2 depicts an exemplary alignment of dipoles in a dielectric according to one embodiment.

In one embodiment, the nanoparticles 300 are polar molecules that will form dipoles 200 in an electric field 202, as the charges separate with a magnitude proportional to the electric field. As shown in FIG. 2, dipoles 200 will align within the dielectric liquid 100. The dipoles 200 will exhibit a polarization charge at its extreme edges. If the net charge on a nanoparticle 300 is zero, as under direct current conditions, then the electric field 202 will not cause it to drift. The polarization magnitude of the surface charge on the nanoparticle 300 under the influence of an electric field is proportional to its dielectric constant. This relationship is defined by the equation: $D=\in E$, where D is the electric displacement field and $\in$ is the dielectric constant ($\in_0\in_r$). D is in units of $C/m^2$ and defines the electric flux density associated with the nanoparticle 300. The dielectric constant of a BST nanoparticle 300 is around 2000.

FIG. 3 depicts a three-dimensional model of an electrode system according to one embodiment, while FIG. 4 depicts a two-dimensional cross-sectional view of the three-dimensional model. The dielectric fluid 100 was modeled as a three-dimensional homogeneous background of material with a constant relative permittivity into which a random distribution of fixed-diameter particles could be introduced. The particles have a different relative permittivity than the background. Conditions such as particle size, particle density, and distance of a single particle from the electrodes were investigated numerically. The simulation suggests that nanoparticle density is a critical parameter, with increased concentrations corresponding to increased average electric field within the simulated dielectric sample.

The results of the electric field models, shown in FIGS. 3-4 indicate that the nanoparticles 300 introduce a field enhancement effect on the cathode 106 surface and within the bulk of the dielectric fluid 100. In one example, the high dielectric constant associated with a nanoparticle 300 of BST is approximately 2000, and therefore excludes electric fields 202 and concentrates them within the dielectric fluid 100 having a dielectric constant of approximately 2. This produces an electric field enhancement at the BST-fluid interface of approximately 1000. A BST nanoparticle 300 near the cathode 106 surface will increase the local electric field 202 in the fluid 100 and increase the probability of electron emission from the cathode. The particle-generated electric fields 202 in the bulk of the fluid 100 may help guide the breakdown streamer across the gap 102.

In one embodiment, the particle shape and/or particle morphology may determine the breakdown characteristics of the system. For example, the particles interact with one or more electrode surface field enhancements that are present at the electrode surface. Repeated discharges may cause pitting and other deformations (other field enhancements) on the surface of the electrodes 104 and 106. The deformations increase the probability that a subsequent breakdown will initiate on or near the field enhancement site. Typically, field enhancements on the electrode surface are either hemispherical or conical. Various simulations conducted to study the interactions between the nanoparticles 300 and various field enhancements indicate that an increasing particle concentration increases the chance that a particle is located near the electrode surface, contributing to an average field increase across the surface of the electrode. This effect allows electrons to be emitted at lower switch voltages.

The results from the simulations also indicate that the interactions between the electrode field enhancements and the high dielectric nanoparticles 300 may contribute to a reduction in jitter. For example, jitter values as low as about 7% have been recorded with nanoparticle suspension and optimized gap-spacing. In one embodiment, the nanoparticles 300 polarize in the applied electric field and disrupt any electric fields at the peaks of the field enhancements while increasing the electric fields at the non-enhanced portions of the electrode surface. Overall, the nanoparticles 300 may function to combine to "smooth" the fields on the electrode surface, thereby reducing jitter in the system. As such, the particular shape and/or morphology of the nanoparticles 300 may be tailored to induce specific breakdown characteristics of the system. For example, the nanoparticles 300 may be spherical, cubic, or irregularly shaped, among others.

The amount of nanoparticles within the dielectric fluid 100 as well as the nanoparticle size, shape, and/or morphology help determine the reduction in the electric field hold-off value in the fluid switching media. Measured values indicate that the electric field hold-off of the fluid can be reduced by over 50% if required. The surfactant also can be used to reduce the voltage breakdown. All of these factors allow the electrode spacing to be increased thereby reducing the effect of the electrode pitting and inherently reducing the jitter of the voltage across the electrodes.

Surfactant

In order to suspend the nanoparticles 300 in the dielectric fluid 100, a surfactant is added to the fluid. In a preferred embodiment, the surfactant is a polar additive. By way of example and not limitation, the surfactant may be oleic acid, alkylbenzene-sulfonic acid, phosphate ester, or other surfactants that are suitable for use in a spark gap. In various embodiments, the surfactant is added to the dielectric fluid 100 to achieve an initial concentration that ranges from approximately 0.1% w/v up to about 10% w/v.

The polarization of the surfactant thereby aids to further reduce the voltage breakdown within the gap 102. In both flowing and non-flowing embodiments of the dielectric fluid 100, the polarization of the surfactant can be used to "tune" or selectively modify the voltage hold-off of the gap 102 without changing the length of the gap. Moreover, in embodiments where the dielectric fluid flows through the gap 102, the surfactant aids in the removal of carbon particles from surfaces of the electrodes 104 and 106, thus further reducing the voltage breakdown jitter. The surfactant also mitigates the agglomeration of the nanoparticles 300.

In one aspect, the surfactant additive, in some instances, may produce a significant decrease in breakdown jitter. For example, simulations have shown that a dielectric fluid, such as PAO, without additives will decrease jitter to some extent; however, one or more additives may be added to decrease the voltage breakdown.

Electric Switch System

Figure 5:
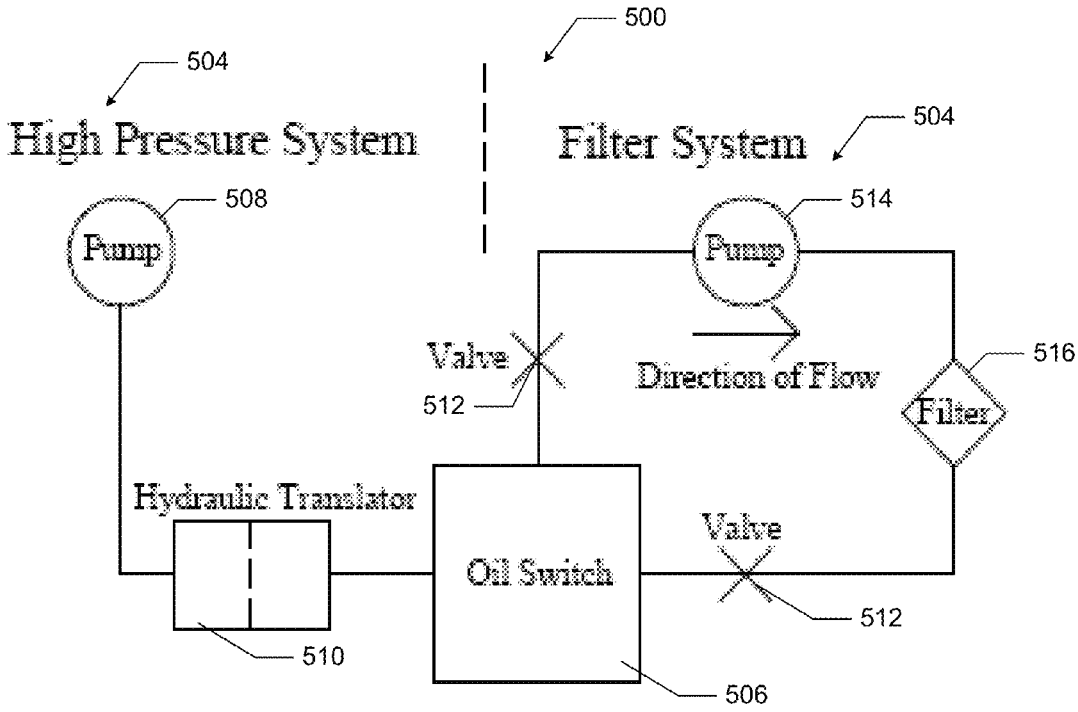
FIG. 5 depicts an embodiment of an electric switch system according to one embodiment.

An electric switch system 500 according to one embodiment is shown in FIG. 5. The electric switch system 500 includes a high-pressure heating system 502, a filtration system 504, and a switch 506.

The high pressure system includes a pump 508 and a hydraulic translator 510 to pressurize and pump the dielectric fluid 100 within the switch 506. In one embodiment, the pump 508 is a hand pump. In other embodiments, the pump 508 may be an electrically-powered pump.

The filtration system 504 includes at least one valve 512, a pump 514, and at least one filter 516. In one embodiment, the valve 512 is an isolation valve that can isolate portions of the filtration system 504 from the high-pressure system 502 and the switch 506.

The pump 514 can be used to pump the dielectric fluid 100 through the switch 506 and through the filter 516. In various embodiments, the pump 514 may pump the dielectric fluid 100 to be filtered before, during and/or after triggering of the switch 506.

The filter 516 filters the dielectric fluid 100. The filter 516 removes large undesirable nanoparticle agglomerates. In various embodiments, the filter 516 has pore diameters ranging from as large as 5 μm to as little as 200 nm. In another embodiment, a series of filters may be used to filter the dielectric fluid 100.

The switch 506 is high-voltage switch having spaced electrodes, similar to the electrodes 104 and 106. In one aspect, the switch 506 also includes a trigger mechanism for operating the switch. The trigger may be a trigatron, a laser pulse, a microwave pulse, or a series injection. By way of example and not limitation, the switch 506 may be a high-voltage system capable of generating a 250-kV voltage pulse across electrodes 104-106 and through the dielectric liquid 100 with a rise-time of 1.6 μs.

Figure 6:
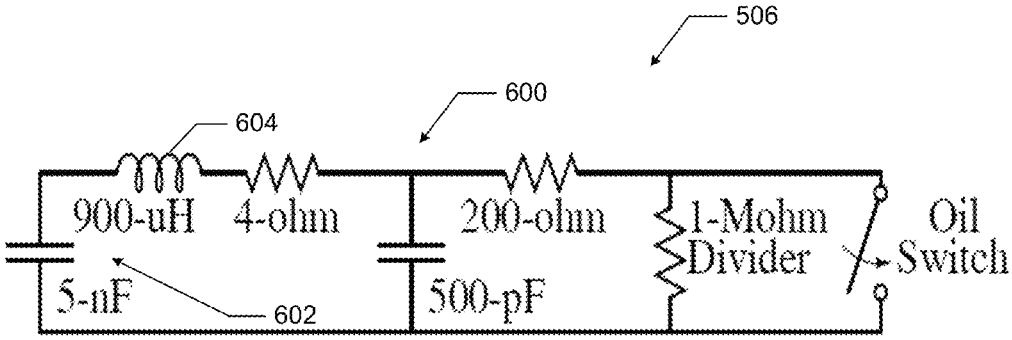
FIG. 6 depicts a circuit schematic of an embodiment of an electric switch according to one embodiment.

In one embodiment, as shown in FIG. 6, the switch 506 includes a Marx-generator circuit 600 that rings a peaking capacitor 602 through a linear inductor 604. The voltage developed on the peaking capacitor 602 is simultaneously applied to the electrodes 104 and 106 of the switch 506. The values shown in FIG. 6 for the various components of the switch 506 are provided for illustration only and do not limit the configuration of the switch.

By way of example and not limitation, the electrodes may be planar 1-inch diameter stainless steel electrodes that may have smooth or rough surfaces. In one embodiment, the electrode gap 102 is externally adjustable. In a preferred embodiment, the gap 102 ranges from 5 μm to 50,000 μm. In various other embodiments, other gap 102 distances may be used. Typically, the gap 102 is set such that the voltage breaks down at 20-100% of the attainable charge voltage.

The switch 506 is configured to apply a voltage across the electrodes 104 and 106 that rises at the rate of approximately 150 kV/μs. In one embodiment, the switch 506 is further configured for self-breakdown operation. Further, in operation, the switch 506 is suited for pressures up to and including 2,500 psig or greater.

In various embodiments, the dielectric fluid 100 may be circulated through and/or within high voltage switches or spark gaps. By way of example and not limitation, the dielectric fluid may be pumped through or otherwise agitated in the gap 102 between the electrodes 104 and 106, thereby causing continuous motion in the fluid in the gap. The fluid 100 may be circulated by a fluid pump or a vibrating device in communication with the fluid.

Figure 7:
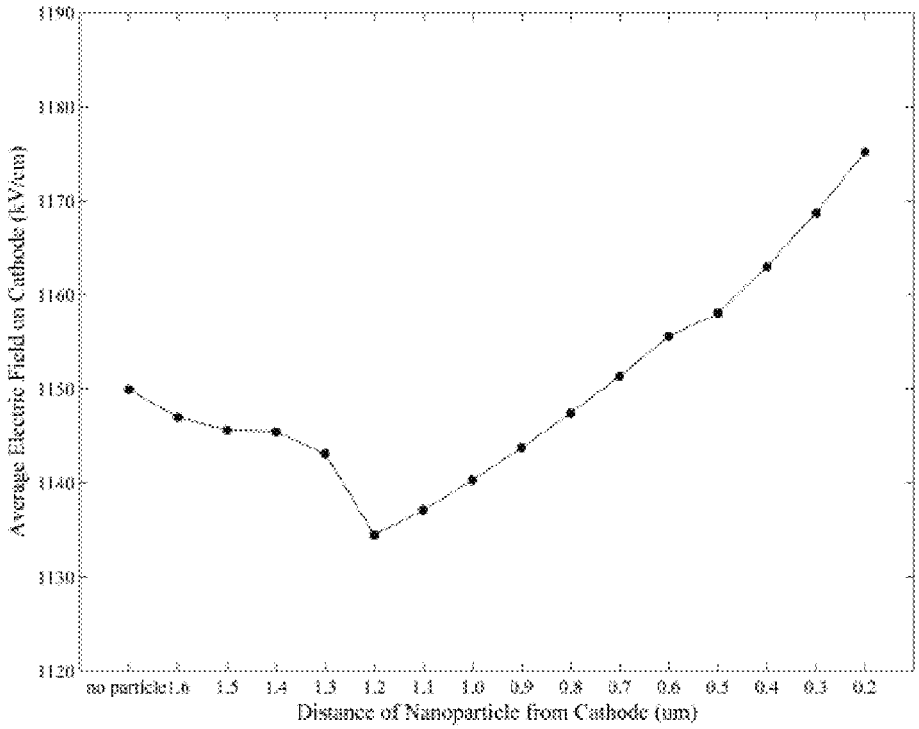
FIG. 7 is a graph depicting the effect of a single particle's distance from the cathode on the average cathode electric field according to one embodiment.

FIG. 7 is a graph depicting the effect of a single particle's distance from the cathode on the average cathode electric field strength according to one embodiment. If the nanoparticles 300 are in close proximity to each other or an electrode, the polarization charge can create the nonlinear electric fields shown in FIG. 4. FIG. 7 provides the results of an exemplary simulation showing the change in the average electric field strength corresponding to a position for a nanoparticle. During the simulation, the nanoparticle was modeled as a 100 nm nanoparticle and the electrodes are modeled as flat electrodes having a 16 μm diameter and 8 μm gap of separation.

Electromagnetic theory suggests that the high dielectric constant of the nanoparticles is a result of their ability to polarize into dipoles in an applied field. This allows a nanoparticle near or on the surface of the cathode to increase the local electric field and act as a field enhancement to draw electrons out of the cathode and into collision with the neutral chains of oil molecules eventually resulting in a breakdown event.

The simulations also suggest that the polarized nanoparticles 300 may change the electric fields within the bulk of the dielectric fluid 100 to act as a path for an ionized streamer to propagate through. The local nonlinear electric fields generated by the polarized nanoparticles 300 may guide the elongating ionized streamer from the cathode electrode 106 to the anode electrode 104 thereby producing more predictable breakdown events.

Figure 8:
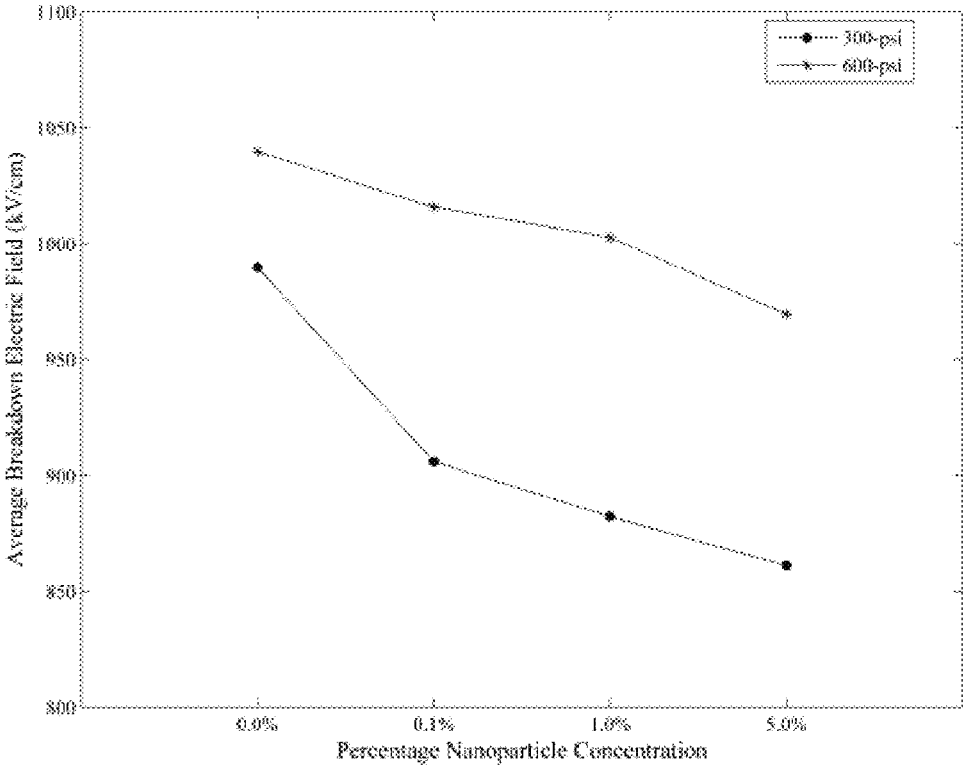
FIG. 8 is a graph depicting the average breakdown electric field in a dielectric liquid with an increasing concentration of nanoparticles according to one embodiment.

Various experimental tests, conducted without filtering the dielectric fluid 100, have shown a marked decrease in the average breakdown electric field with increasing concentrations of nanoparticles 300. It is thought that this may be due to the large extraction fields generated by the nanoparticles on the surface of the cathode and in the bulk of the oil. FIG. 8 is a graph depicting the average breakdown electric field in a dielectric liquid with an increasing concentration of nanoparticles 300 according to one embodiment, where an inline filter of 5 μm, similar to the filter 516, was used for these tests.

These measurements were gathered using a switch, similar to the switch 506, where the flat electrode gap spacing was set at 0.18 cm. The flat electrode geometry was used to generate a uniform electric field across the gap and mitigate the effect of field enhancement. During the test cycle 150 shots were taken with 75 shots taken per pressure. The oil utilized was a hydrogenated 1-decene polyalphaolefin.

The decrease of the electric breakdown strength in oil can be counteracted by a minimal increase in the gap spacing of the switch, so it should not be considered a detrimental effect. It is included in this section to show that the nanoparticles have a realizable effect on the breakdown. The decrease in the breakdown strength is even less significant considering that the tests in FIG. 4 were completed with no pre-filtering of the oil. After pre-filtering, it is predicted that there is less than 5% of the original nanoparticles remain in suspension.

Figure 9:
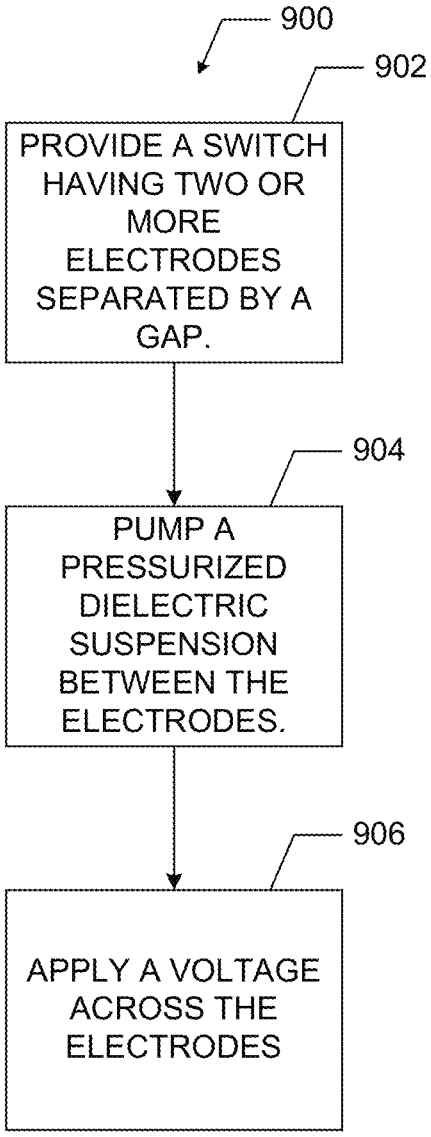
FIG. 9 is a flowchart depicting a method for reducing voltage breakdown jitter in a high voltage switch system according to one embodiment.

FIG. 9 depicts a method, indicated generally as 900 for reducing voltage breakdown jitter in a high voltage switch system, such as the switch system 500. At step 902, a switch having two or more electrodes 104-106 separated by a gap 102 is selected. At step 904, a pressurized dielectric suspension is pumped between the electrodes. The dielectric suspension includes the dielectric fluid 100, a surfactant to reduce a breakdown voltage of the dielectric fluid and to remove carbon from at least one of the two or more electrodes 104-106. The dielectric suspension also includes a plurality of nanoparticles, 300 held in suspension due at least in part to the surfactant, to enhance the formation of streamers thereby effectively reducing the electrode gap 102.

A voltage is applied across the two or more electrodes to form an electric field, at step 906. Within the electric field, the surfactant helps to reduce the breakdown voltage and the nanoparticles 300 encourage the formation of streamers that enhance the electric field between the electrodes 104-106. In one embodiment, the combination of the dielectric liquid 100, surfactant, and nanoparticles 300 work in combination to reduce the voltage breakdown jitter in the gap 102.

Figure 10:
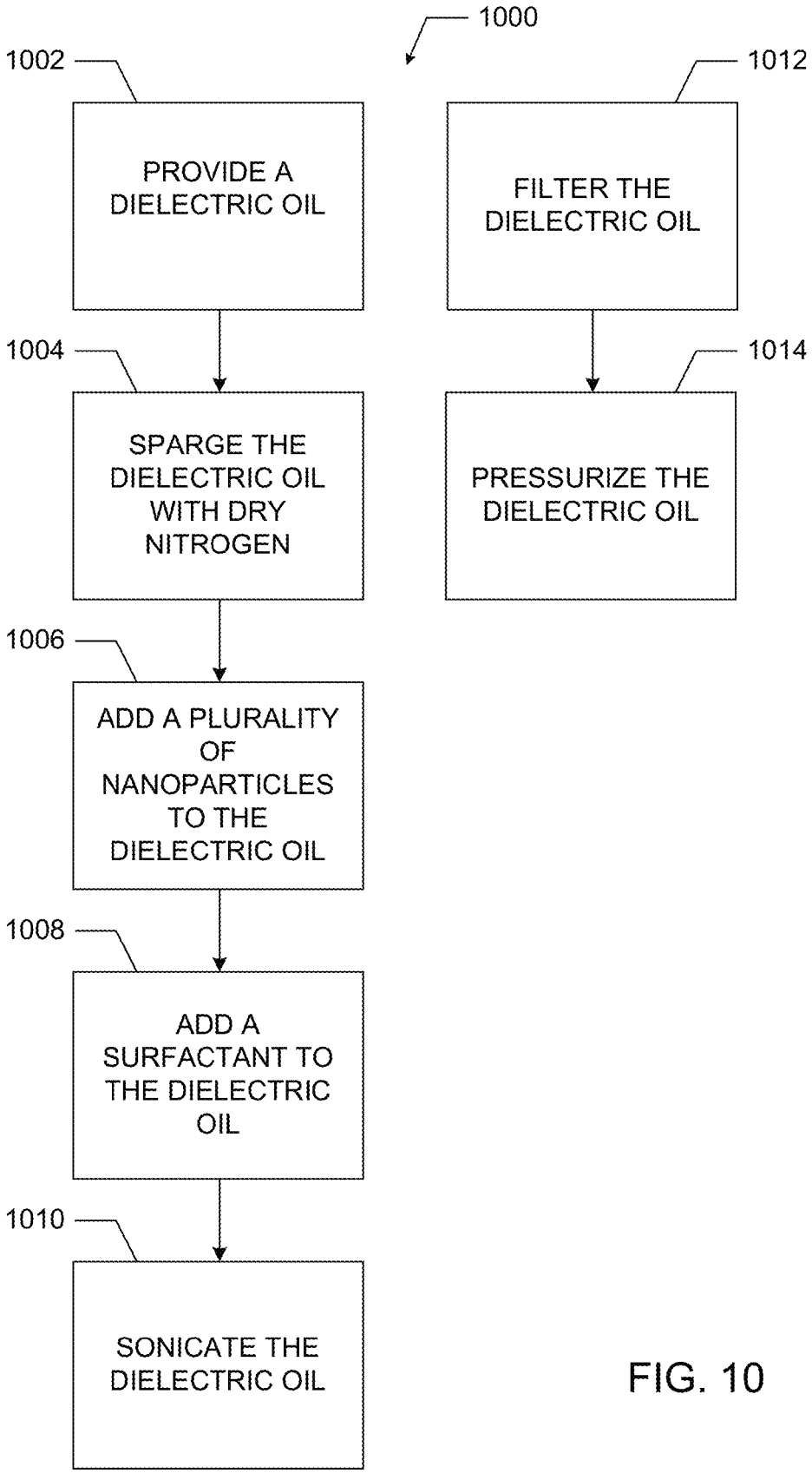
FIG. 10 is a flowchart depicting a method for preparing a dielectric fluid to reduce voltage breakdown jitter in a high voltage spark gap according to one embodiment.

FIG. 10 depicts a method, indicated generally as 1000 for preparing a dielectric fluid to reduce voltage breakdown jitter in a high voltage spark gap. At step 1002, a dielectric oil to serve as the dielectric fluid 100 is prepared. The dielectric oil is sparged with dry nitrogen at step 1004. In one embodiment, the dielectric oil is sparged before being pumped into in the switch. The dielectric oil is sparged to reduce the water concentration to a uniform level of around 20 ppm or less.

At step 1006, the plurality of nanoparticles 300 are added to the dielectric oil, while at step 1008 the surfactant is added to the dielectric oil. The oil, nanoparticles 300, and surfactant combination is sonicated at step 1010 to break up the nanoparticles and disperses them throughout the oil to maintain an adequate suspension of the nanoparticles in the oil. The oil, nanoparticles 300, and the surfactant are then filtered at step 1012 to sufficiently remove the large nanoparticles agglomerates from the oil. In various embodiments, multiple filtering steps are used. For example, pre-filtering is necessary to sufficiently remove the large nanoparticles agglomerates from the oil so that it can be passed through the filter to remove carbon during a rep-rate operation. In this example, the oil is filtered by a vacuum filtration system that starts with a large pore size filter and uses other small-pore size filters. The oil and suspended additives are then pressurized at step 1014 to reduce the vapor bubble size and/or eliminate microcavities that result from an arc traveling through the oil.

Example Dielectric Liquid Preparation Method

By way of example and not limitation, an exemplary method used to prepare the dielectric oil suspension is provided. An initial evaluation of a number of dielectric fluids was conducted to evaluate both the average electric field strength at breakdown over a number of breakdowns. The evaluation also considered the percent standard deviation of the electric field, which was defined as the ratio of the standard deviation to the mean value of the breakdown electric field for a sample of breakdown at approximately 20-80% of the attainable charge voltage. The selected dielectric fluids were military-grade decene-based poly-α-olefins and synthetic hydrocarbons having a controlled dielectric constant. The selected oils were first pre-filtered through a 0.45-μm filter nitrocellulose filter to remove macro particle contaminants. Next BST particles and a chemical surfactant were added at with concentrations of 5% and 1% by weight relative to the volume of the suspension, respectively. An ultrasonic liquid processor was activated after the addition of the BST particles for a period of time, which then caused the particles to break apart and dispersed them throughout the oil. The oil was then filtered by a vacuum filtration system that had a filter pore size of 5 μm. The pore size was gradually decreased until the nanoparticle oil passed easily through it. In this example, the oil was then passed through pre-filters having pore sizes that range from 200 nm to 5000 nm. In addition, the oil suspension was subjected to inline filtering using filter pore sizes ranging from 200 nm to 5000 nm. Before being placed in the switch system, the oil was sparged with dry nitrogen for 5 to 10 minutes to reduce the water concentration to a uniform level of around 20 ppm or less. The oil and nanoparticle suspension was then placed in the switch and tested. By way of example, and not limitation the simulated gap was approximately 8 μm which corresponded to an experimental gap spacing of approximately 1.8 cm.

Experimental Results

Table 1 presents experimental results using a variety of dielectric fluid configurations, filter configurations, and the corresponding breakdown jitter results. These tests were performed with an electric switch system in the same configuration as the system of the *Electrostatic Field Simulation Study of Nanoparticles Suspended in Synthetic Insulating Oil* publication. The first tests were done with hexadecane oil to establish a baseline.

The most desired results we obtained were from the NYCO oil pre-filtered through the 5-μm filter and filtered through a 5-μm filter during testing. The value of the percent standard deviation (PSD) was 7.61% at 600-psi. The second best PSD of 9.80% was found with the NYCO oil pre-filtered with the 1-μm filter and filtered through a 1-μm filter during testing. After several test cycles at 300 and 600 psi, it was determined that lower PSD values were being found at the higher pressure.

One of the NYCO oil samples was contaminated with water saturated Diala AX transformer oil and was included in the table to show how increased water content can influence the results. The water was removed through sparging and retested with significantly better results.

TABLE I

Breakdown Results of Two Oils with Nanoparticle Suspension

| Oil Name | Mean Breakdown Voltage (kV) | | Percent Standard Deviation (PSD) | | Pre-Filter Size | Inline Filter Size | Clogged | Water (ppm) |
|---|---|---|---|---|---|---|---|---|
| | 300-psi | 600-psi | 300-psi | 600-psi | | | | |
| Hexadecane No Nano | 177.0 | 188.4 | 14.88% | 11.03% | none | 1-um | no | 20 |
| Hexadecane 5% BST 1% Surfactant* | 176.4 | 186.0 | 17.28% | 14.53% | none | 5-um | yes | 22 |
| Hexadecane 5% BST 1% Surfactant | 163.2 | 173.8 | 9.57% | 9.93% | 1-um | 1-um | yes | 18 |
| Nyco MIL-PRF-87252 No Nano | 176.7 | 185.5 | 13.36% | 13.55% | none | 1-um | no | 22 |
| Nyco MIL-PRF-87252 5% BST 1% Surfactant | 162.2 | 180.4 | 13.30% | 7.61% | 5-um | 5-um | no | 21 |
| Nyco MIL-PRF-87252 5% BST 1% Surfactant | 155.2 | 173.4 | 13.05% | 9.80% | 1-um | 1-um | yes | 20 |
| | 600-psi | 1000-psi | 600-psi | 1000-psi | | | | |
| Nyco MIL-PRF-87252 5% BST 1% Surfactant | 146.0 | 164.8 | 16.97% | 14.05% | 0.2-um | .45-um | yes | 68** |
| Nyco MIL-PRF-87252 5% BST 1% Surfactant*** | 183.7 | 196.7 | 14.68% | 10.25% | 0.2-um | 5-um | no | 17 |
| Nyco MIL-PRF-87252 5% BST 1% Surfactant | 162.5 | 172.2 | 13.40% | 10.24% | .45-um | 5-um | no | 23 |
| Nyco MIL-PRF-87252 5% BST 1% Surfactant | 176.8 | 187.6 | 14.21% | 11.10% | 1-um | 5-um | no | 22 |

*All percentages are by weight

**This sample was contaminated by water saturated DialaAX transformer oil before testing

***This is the contaminated sample resparged and retested

It will be appreciated that the device and method of the present invention are capable of being incorporated in the form of a variety of embodiments, only a few of which have been illustrated and described above. The invention may be embodied in other specific forms without departing from its spirit or essential characteristics. The described embodiments are to be considered in all respects only as illustrative and not restrictive and the scope of the invention is, therefore indicated by the appended claims rather than by the foregoing description. All changes which come within the meaning and range of equivalency of the claims are to be embraced within their scope.

What is claimed is:

1. A method for preparing a dielectric fluid to reduce voltage breakdown jitter in a high voltage spark gap comprising:

providing the dielectric fluid;

sparging the dielectric fluid with dry nitrogen;

adding a plurality of nanoparticles to the dielectric fluid;

adding a surfactant to the dielectric fluid;

sonicating the dielectric fluid;

filtering the dielectric fluid; and, pressurizing the dielectric fluid.

2. The method of claim 1 wherein the dielectric fluid is a polyolefin having a chemical formula of $C_{16}H_{32}$ or a hydrocarbon-based coolant fluid.

3. The method of claim 2 wherein the polyolefin is 1-Hexadecene.

4. The method of claim 2 wherein the hydrocarbon-based coolant fluid is a military-grade synthetic hydrocarbon-based fluid.

5. The method of claim 1 wherein sparging the dielectric fluid with dry nitrogen reduces a water content of the dielectric fluid to less than approximately 20 ppm.

6. The method of claim 1 wherein the plurality of nanoparticles comprises barium strontium titanate (BST) nanoparticles.

7. The method of claim 1 wherein the plurality of nanoparticles are added to obtain a concentration in the dielectric fluid of 0.1% w/v or greater.

8. The method of claim 1 wherein the plurality of nanoparticles are added to obtain a concentration in the dielectric fluid ranging between 0.1% w/v and 10% w/v.

9. The method of claim 1 wherein the surfactant is added to obtain a concentration in the dielectric fluid of 0.1% w/v or greater.

10. The method of claim 1 wherein the surfactant is added to obtain a concentration in the dielectric fluid ranging between 0.1% w/v and 10% w/v.

11. The method of claim 1 wherein the plurality of nanoparticles have a dielectric constant of ranging from 20-6000.

12. The method of claim 1 wherein a ratio of the dielectric constant of the plurality of nanoparticles to another dielectric constant of the dielectric fluid is at least 3:1.

13. The method of claim 1 wherein a ratio of the dielectric constant of the plurality of nanoparticles to another dielectric constant of the dielectric fluid is at least 10:1.

14. The method of claim 1 wherein a ratio of the dielectric constant of the plurality of nanoparticles to another dielectric constant of the dielectric fluid is at least 20:1.

15. The method of claim 1 wherein a ratio of the dielectric constant of the plurality of nanoparticles to another dielectric constant of the dielectric fluid is at least 2000:1.

16. The method of claim 1 wherein the plurality of nanoparticles range in diameter from about 2 nm to about 40 μm.

17. The method of claim 1 wherein the dielectric fluid is pressurized to between about atmospheric pressure.

18. The method of claim 1 wherein the dielectric fluid is pressurized to about 10 psig or greater.

19. The method of claim 1 wherein the dielectric fluid is pressurized to between about 10 psig and 2,500 psig.

* * * * *